United States Patent [19]

Pleier

[11] 4,023,650

[45] May 17, 1977

[54] HYDRAULIC SYSTEMS FOR TWO SPEED LIFTING

[75] Inventor: Walter J. Pleier, Bristol Township, Bucks County, Pa.

[73] Assignee: Eaton Corporation, Cleveland, Ohio

[22] Filed: Aug. 20, 1975

[21] Appl. No.: 606,034

[52] U.S. Cl. ..... 187/9 R; 91/411 B; 91/412; 187/17

[51] Int. Cl.[2] ..... B66B 9/20; F15B 11/16

[58] Field of Search ..... 187/1 R, 9 R, 9 E, 17; 91/411 B, 412, 411 A, 391 R, 441; 254/89 H, 93 R

[56] References Cited

UNITED STATES PATENTS

| | | | |
|---|---|---|---|
| 1,944,351 | 1/1934 | Landry | 91/411 B X |
| 2,456,320 | 12/1948 | Repke | 187/9 E X |
| 2,588,285 | 3/1952 | Pelouch | 92/81 X |
| 3,186,309 | 6/1965 | Killebrew | 91/412 |
| 3,541,928 | 11/1970 | Conwell et al. | 187/17 X |
| 3,584,536 | 6/1971 | Hillberry | 91/412 X |
| 3,608,434 | 9/1971 | Hillberry | 91/411 B |
| 3,734,464 | 5/1973 | Bushnell | 91/412 X |

*Primary Examiner*—Evon C. Blunk
*Assistant Examiner*—James L. Rowland
*Attorney, Agent, or Firm*—Teagno & Toddy

[57] ABSTRACT

Hydraulic systems particularly adaptable for use in industrial lift trucks utilizing two or more hydraulic cylinders to lift a load. The cylinders are positively connected to the load, and valve means are provided for directing pressurized fluid to the working chambers of all cylinders when heavily loaded and to fewer cylinders when lightly loaded. Other valve means are provided for directing fluid to the working chambers of the unpressurized cylinders.

20 Claims, 3 Drawing Figures

HYDRAULIC SYSTEMS FOR TWO SPEED LIFTING

BACKGROUND OF THE INVENTION

1. Field Of The Invention

The invention relates generally to hydraulic systems for lifting loads, more specifically to such systems wherein lifting speed may be varied in response to changes in the magnitude of the load, and most specifically to the adaptation of such systems for use in industrial lift trucks.

2. Description Of The Prior Art

Hydraulic circuits for lifting heavy loads at low speeds and light loads at high speeds are known in the prior art. The prior art circuits have suffered from certain disadvantages, however. Most have been suitable for use only in lifting systems employing a single lift cylinder. See, e.g., U.S. Pat. No. 3,071,926 to Olson et al. Those which have been adapted for use in multiple cylinder systems have disadvantageously required manual selection of the speed of operation and/or have failed to effectively provide for smooth, efficient operation. The latter disadvantage is due to the fact that dual speed operation is effected in these systems by disenabling certain cylinder working areas during high speed operation, but provision is not made for maintaining fluid in these areas while minimizing system pressure losses and component complexity. Example of such systems may be seen in U.S. Pat. Nos. 3,530,767 and 3,824,896 to Shook and Tull III.

SUMMARY OF THE INVENTION

It is therefore an object of the present invention to provide a vehicle having a simple hydraulic circuit for lifting a load by use of multiple lift cylinders wherein the cylinders operate at low speed with high power or at high speed with low power upon sensing the magnitude of the load.

It is a further object to provide a circuit that prevents cavitation and ensures smooth movement of the cylinders during the dual speed operation.

It is a still further object to provide a circuit in which pressure drops are minimized and system simplicity is enhanced.

According to one feature of the present invention a load responsive valve is provided which blocks flow to some of the cylinders when the load is light whereby allowing two speed operation.

According to another feature all cylinders are positively connected to the load and means are provided to direct unpressurized fluid to the unused cylinders during high speed operation thereby preventing cavitation and ensuring smooth operation.

According to still another feature the means for directing unpressurized fluid to the unused cylinder are integrally formed with the unused cylinders to minimize system pressure drops and complexity.

BRIEF DESCRIPTION OF THE DRAWING

These as well as other objects and features will be recognized by those skilled in the art of hydraulic lifting upon reading the accompanying description with reference to the accompanying drawing in which.

DESCRIPTION OF THE PREFERRED EMBODIMENT

Figure 1:
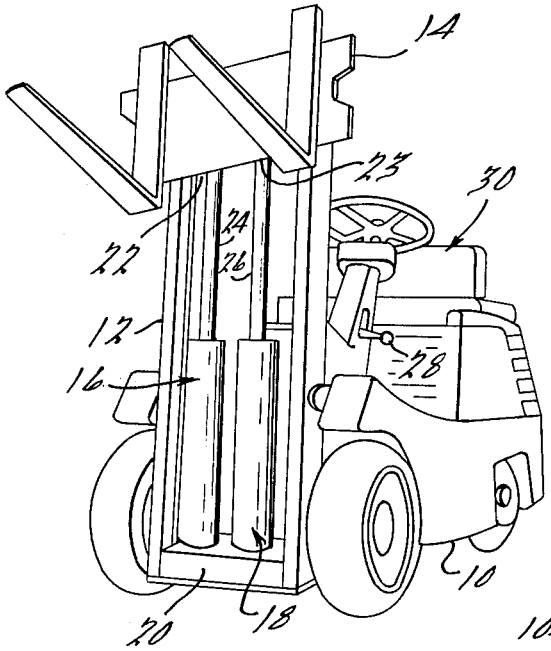
FIG. 1 is a perspective view of the hydraulic circuit of the present invention as used in an industrial lift truck.

Referring now to FIG. 1 the hydraulic system of the present invention is illustrated as being installed on an industrial forklift truck 10. The truck includes an upstanding mast 12 and a load carrying member 14 mounted for movement therealong. First and second hydraulic lift cylinders 16 and 18 are rigidly secured to the upstanding mast 12 at the base 20 and to the load carrying member 14 at the outward ends 22 and 23 of rams 24 and 26, respectively. A control lever 28 operatively connected to a hydraulic circuit to be described below is located proximate the driver's station 30 of the truck 10.

Figure 2:
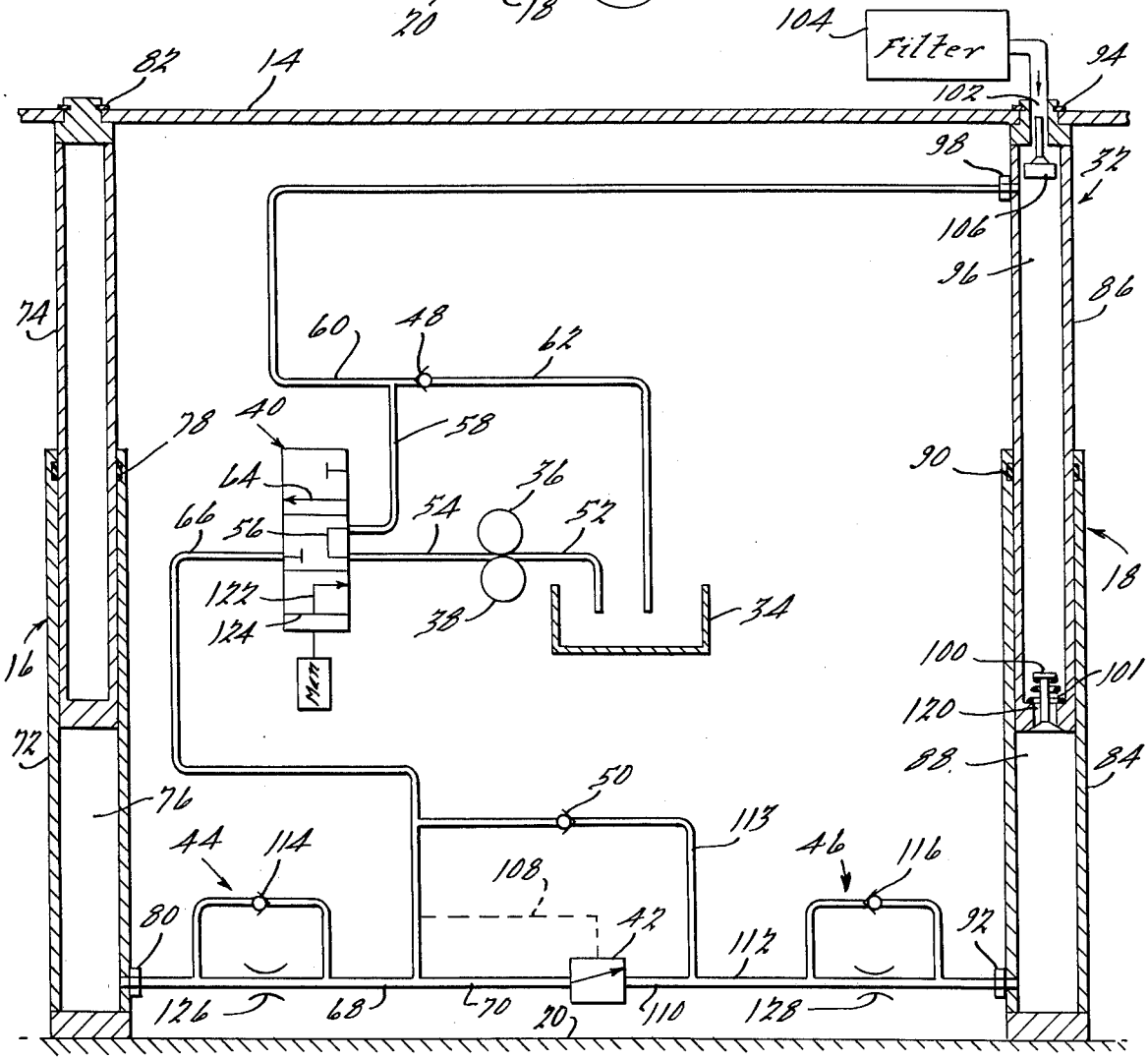
FIG. 2 is a schematic drawing of the circuit employing displacement type lift cylinders.

Referring now to FIG. 2, a hydraulic circuit 32 schematically illustrates how first and second lift cylinders 16 and 18 may be operated in lift truck 10 to raise and lower a load. The circuit 32 is illustrated as including a primary fluid reservoir 34, a fixed displacement pump 36 drivingly carried by a prime mover 38 mounted on the lift truck 10, a manually operated directional control valve 40, a load responsive shut off valve 42, first and second lowering flow control valves 44 and 46, a reservoir relief valve 48, a bypass valve 50, and the first and second lift cylinders assemblies 16 and 18.

The primary fluid reservoir 34 is fluidly connected to the inlet of the pump 36 by a conduit 52. The outlet of the pump 36 is fluidly connected to the directional control valve 40 by a conduit 54. The control valve 40 is manually operable by means of the lever 28 from the neutral position shown in FIG. 2 either downwardly to raise the load or upwardly to lower it. When in the neutral position shown fluid communication is provided from the pump 36 through the conduit 54 and an internal passage 56 within the directional control valve 40 and a conduit 58 to a conduit 60 communicating with second lift cylinder 18 or through reservoir relief valve 48 and a conduit 62 to the reservoir 34. When the valve 40 is moved downwardly to the "raise" position, fluid communication is provided from the conduit 54 through an internal passage 64 in the directional control valve 40 to a conduit 66, which communicates with branch conduits 68 and 70 leading through load responsive shut off valve 42 and flow controls 44 and 46 to the first and second lift cylinders 16 and 18. When the directional control valve 40 is in the "lower" position fluid communication is provided from both conduits 54 and 66 to conduit 58.

First lift cylinder 16 is illustrated as including a cylinder housing 72 which is secured to the mast 12 of the vehicle 10 and a ram or piston member 74 slidingly received therein. A working fluid chamber 76 is defined by the housing 72 and the piston member 74, and a sliding seal 78 is provided between the two members. A fluid connection 80 is provided between the working fluid chamber 76 and the flow control valve 44 and a positive connection 82 is provided between the piston member 74 and the load carrying member 14 of the truck 10.

The second lift cylinder 18 similarly includes a cylinder housing 84, a piston member 86, a working fluid chamber 88, a sliding seal 90, a fluid connection 92 to flow control valve 46, and a positive connection 94 to the load carrying member 14. Second lift cylinder 18 further includes, however, a secondary fluid reservoir 96 formed within the piston member 86, a fluid connection 98 from the secondary reservoir to the conduit 69, and a nonreturn valve 100 carried by the piston member 86 fluidly connecting the working chamber 88 and the secondary reservoir 96. A vent port 102 communicates the secondary reservoir 96 with atmosphere having an air filter 104 disposed downstream thereof, and a float valve 106 is carried in the secondary reservoir 96 and is operative to prevent the flow of hydraulic fluid from the passage 102.

OPERATION OF THE HYDRAULIC CIRCUIT

When a load is to be lifted the lever 28 is moved so as to position the directional control valve 40 downward from the position shown in FIG. 2. The entire output flow of the pump 36 is thereby directed to the conduit 66 and from there to conduits 68 and 70. The pressure at which the fluid is directed is proportional to the magnitude of the load to be lifted. If the load is heavy the pressure in conduit 66 is high, this pressure is transmitted through a pilot or sensing line 108 to operate the load responsive shut off valve 42 to provide communication between the conduit 70 and a conduit 110. This communication being effected, pressurized flow from the conduit 66 is divided and flows equally to flow control valves 44 and 46. Each of these valves is of a known design and includes low differential pressure check valves 114 and 116 to provide for the free flow of fluid to the hydraulic cylinders 16 and 18. The load on load carrying member 14 is thereby lifted at a predetermined speed proportional to the total area of the lift cylinders 16 and 18 and the output flow of the pump 36.

When the load carried by the load carrying member 14 is less than a predetermined value, the pressure transmitted from the conduit 66 through sensing line 108 to the valve 42 is insufficient to shift the valve 42 to provide communication between the conduits 70 and 110; and the entire output of the 36 is directed through the flow control valve 44 to the working chamber 76 of the first lift cylinder 16. Since the rate of flow from the pump 36 under both light and heavy load conditions is essentially constant, the directing of the fluid to the single lift cylinder 16 causes an increase in lifting speed proportional to the change in cylinder area, essentially a doubling of this speed in the embodiment described here.

It should be noted that as the piston member 74 of the first lift cylinder 16 is extended during the lifting of the light load, the piston member 86 of the second lift cylinder 18 is likewise extended, owing to the positive connection 94 between it and the load carrying member 14 to which both piston members are connected. To prevent cavitation in the working chamber 88 of the second lift cylinder assembly 18 during this mode of operation and to ensure that the chamber 88 is completely filled with fluid for subsequent pressurization thereby providing for smooth operation, the nonreturn valve 100 is provided. The valve 100 is lightly preloaded as by a spring 101 to effect a seal between the working fluid chamber 88 and the secondary reservoir 96. Upward movement of the piston member 86 carried by the load carrying member 14 reduces the pressure in the working fluid chamber 88 below that in the secondary reservoir chamber 96, which is filled with fluid. This causes movement of the valve 100 to open a relatively large passage 120 in the end of the piston member 86, thereby allowing fluid to flow from the secondary reservoir 96 to the working chamber 88 with relatively little pressure drop. Since during the lifting mode of operation the secondary reservoir is not in direct communication with either the pump 36 or the primary fluid reservoir 34 the secondary reservoir 96 is vented to atmosphere to enhance the flow of fluid therefrom. This venting is effected through the passage 102 which is closed by float valve 106 only when the secondary reservoir 96 is filled with fluid.

Figure 3:
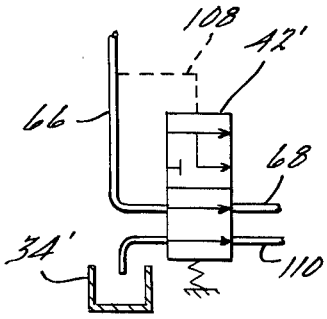
FIG. 3 is a partial schematic drawing of a circuit for use in an alternate embodiment.

In another embodiment the secondary reservoir 96, the non-return valve 100, and the associated venting means are eliminated and fluid is drawn into the working chamber 88 during the light load operation by including load responsive valving means connecting the chamber 88 to the reservoir 34 in this mode of operation. Such valving means is included with the load responsive shut off valve as is shown schematically in FIG. 3. A valve 42′ replaces valve 42 and is biased to provide fluid communication between the conduit 66 and the conduit 68 and between reservoir 34′ and the conduit 110 allowing fluid to be drawn into chamber 88 during light load operation. Increased loads are sensed at sensing line 108 as previously described to shift the valve 42′, providing fluid communication between the conduit 66 and both working chambers 76 and 88.

Upon moving the lever 28 to position the directional control valve 40 in the neutral position shown in FIG. 2, fluid is directed from the pump 36 through the conduit 54, internal passage 56, conduits 58 and 60, and the fluid connection 98 to the secondary reservoir 96 until the reservoir 96 is filled and the float valve 106 closes the vent passage 102. At this time pressure in the mentioned conduits increases sufficiently to open reservoir relief valve 48 and the output of the pump 36 is then conducted through the conduit 62 to the primary reservoir 34.

When the lever 28 is moved to position the directional control valve 40 upwardly from the position shown in FIG. 2 to lower the load carrying member 14, the output of the pump 36 is allowed to flow from the conduit 54 through an internal passage 122 in the valve 40 and to conduits 58, 60 and 62 as hereinabove described. When the valve 40 is in the lowering position, conduit 66 is connected to internal passage 124 to join internal passage 122 so that fluid flowing out of the working chambers 76 and 88 at a rate controlled by orifices 126 and 128 of flow control valves 44 and 46 is directed to the conduit 66 and thence to reservoirs 96 and 34 through the circuit hereinabove described. Fluid from the chamber 76 passes from the flow control 44, and conduit 68 to the conduit 66 while fluid from the chamber 88 passes from the flow control 46 through branch conduits 112 and 113, bypassing the valve 42 through bypass valve 50 to conduit 66.

While the present invention has been described in only two embodiments, those skilled in the art will realize that other embodiments and modifications of these embodiments may be made without departing from the spirit of the invention as claimed. Among these embodiments and modifications are the provision of a greater number of lift cylinders controlled or not controlled by load responsive valves, and the provisiion of other means for venting the secondary reservoir where the cylinders are not vertically disposed.

I claim:

1. A vehicle for use in lifting a load, said vehicle comprising:

A. a vertically disposed mast fixed to said vehicle;

B. a load carrying member mounted for vertical movement along said mast;

C. a plurality of piston-cylinder assemblies, each assembly including:

1. a cylinder housing;
2. a piston member slidingly received in said housing, defining therewith a working fluid chamber, and including a portion extending therefrom for engaging said load carrying member; and
3. means for positively connecting said lift cylinders to said load carrying member;

D. fluid supply means operative in one condition to supply pressurized fluid at a fixed rate to the working fluid chambers of said piston-cylinder assemblies thereby lifting said load at a predetermined rate;

E. means for sensing the magnitude of said load and for blocking said flow of pressurized fluid to at least one of said piston-cylinder assemblies when said sensed load is less than a predetermined magnitude, thereby increasing the speed with which said load is lifted; and F. reservoir means formed within the piston member of said at least one piston-cylinder assembly and including means operative to allow unpressurized fluid to flow from said piston reservoir means to said working chambers of said at least one piston-cylinder assembly when said load is less than said predetermined magnitude.

2. The vehicle as defined in claim 1 wherein said means for sensing and blocking comprises pressure responsive means disposed fluidly intermediate said supply means and said at least one piston-cylinder assembly and including means for communicating said pressure responsive valve means with said pressurized fluid to thereby operate said valve means between a closed position when said pressurized fluid is at a pressure less than a predetermined value and an open position when said pressure is equal to or greater than said value, said value being representative of the magnitude of said load.

3. The vehicle as defined in claim 1 wherein said means operative to allow flow comprises a non-return valve disposed fluidly intermediate said piston reservoir and said working fluid chamber whereby communication therebetween is blocked when said working chamber is supplied pressurized fluid and is opened when the flow of pressurized fluid to said working chamber is blocked and the related piston member is lifted with said load by said remaining piston-cylinder assemblies.

4. The vehicle as defined in claim 3 wherein said non-return valve is carried with said piston member.

5. The vehicle as defined in claim 3 wherein said means operative to allow flow further comprises means for venting said piston reservoir to atmosphere when said non-return valve opens communication between said piston reservoir and said working chamber.

6. The vehicle as defined in claim 5 wherein said means for venting comprises a float valve carried within said piston reservoir and moveable in response to changes in the level of the fluid therein from a closed position when said reservoir is filled with fluid to an open position when the fluid level in said piston reservoir drops as fluid is transferred therefrom.

7. The vehicle as defined in claim 1 wherein said fluid supply means is operative in another condition supplying unpressurized fluid to said piston reservoir.

8. The vehicle as defined in claim 7 wherein said fluid supply means includes a system reservoir and said fluid supply means is operative in said other condition to direct unpressurized fluid to said system reservoir when said piston reservoir is filled with fluid.

9. A hydraulic system for moving a load, said system comprising:

A. a plurality of fluid motors each having a working chamber, and mechanical output member positively connected to said load;

B. means operable to supply pressurized fluid at a fixed rate to the working chambers of all of said motors to thereby move said load at a predetermined speed;

C. means for sensing the magnitude of said load and for blocking the flow of pressurized fluid to at least one of said motors when said load is less than a predetermined magnitude, thereby increasing the speed with which said load is moved; and D. motor reservoir means operatively carried with said mechanical output member of said at least one motor means and including means operative to allow unpressurized fluid to flow from said motor reservoir means to the working chamber of said at least one motor when said load is less than said predetermined value.

10. A hydraulic system for moving a load, said system comprising:

A. a plurality of piston-cylinder assemblies, each including:

1. a cylinder housing,
2. a piston member slidingly received in said housing, defined therewith a working fluid chamber, and including a portion extending therefrom for engaging said load; and
3. means for positively connecting said assembly to said load;

B. fluid supply means operative in one condition to supply pressurized fluid at a fixed rate to the working fluid chambers of all of said assemblies to thereby move said load at a predetermined speed;

C. means for sensing the magnitude of said load and for blocking said flow of pressurized fluid to said chamber of at least one of said piston cylinder assemblies when said sensed load is less than a predetermined magnitude, thereby increasing the speed with which said load is moved; and D. reservoir means formed within said piston of said at least one assembly and including means operative to allow unpressurized fluid to flow from said piston reservoir means to said working chamber of said at least one piston-cylinder assembly when said load is less than said predetermined magnitude.

11. The system as defined in claim 10 wherein said means operative to allow flow comprises a non-return valve disposed fluidly intermediate said piston reservoir and said working fluid chamber whereby communication therebetween is blocked when said working chamber is supplied pressurized fluid and is opened when the flow of pressurized fluid to said working chamber is blocked and the related piston member is moved with said load by the other piston-cylinder assemblies.

12. The system as defined in claim 11 wherein said non-return valve is carried with said piston member.

13. The system as defined in claim 11 wherein said means operative to allow flow further comprises means for venting said piston reservoir to atmosphere when said non-return valve opens communication between said piston reservoir and said working chamber.

14. The system as defined in claim 13 wherein said means for venting comprises a float valve carried within said piston reservoir and moveable in response to changes in the level of the fluid therein from a closed position when said piston reservoir is filled with fluid to an open position when the fluid level in said piston reservoir drops as fluid is transferred therefrom.

15. The system as defined in claim 10 wherein said fluid supply means is operative in another condition to supply unpressurized fluid to said piston reservoir.

16. The system as defined in claim 15 wherein said fluid supply means includes a system reservoir and said fluid supply means is operative in said other condition to direct unpressurized fluid to said system reservoir when said piston reservoir is filled with fluid.

17. A hydraulic piston-cylinder assembly, said assembly comprising:

A. a housing having a cylindrical bore formed therein and a base portion closing one end thereof;

B. a piston member having a substantially cylindrical configuration, slidingly received in said housing, defining a working fluid chamber between one end of said piston member and said base portion, and including a portion extending from said housing for engaging a load;

C. a fluid reservoir chamber formed within said piston member;

D. first fluid port means for communicating said working chamber with pressurized fluid;

E. second fluid port means for communicating said reservoir chamber with unpressurized fluid; and F. non-return valve means disposed fluidly intermediate said reservoir chamber and said working chamber and operative to allow the flow of fluid from said reservoir chamber to said working chamber when said working chamber is not supplied pressurized fluid and said piston member is moved away from said base.

18. The assembly as defined in claim 17 wherein said non-return valve is carried with said piston member.

19. The assembly as defined in claim 17 and further including means for venting said reservoir chamber when said non-return valve is operated to allow the flow of fluid therefrom.

20. The assembly as defined in claim 19 wherein said means for venting comprises a float valve carried within said reservoir chamber and moveable in response to changes in the level of fluid therein from a closed position when said reservoir chamber is filled with fluid to an open position when the fluid level in said reservoir chamber drops as fluid is transferred therefrom.

* * * * *

UNITED STATES PATENT AND TRADEMARK OFFICE

CERTIFICATE OF CORRECTION

PATENT NO. : 4,023,650

DATED : May 17, 1977

INVENTOR(S) : Walter J. Pleier

It is certified that error appears in the above-identified patent and that said Letters Patent are hereby corrected as shown below:

Col, 1 line 48: "whereby" should read "thereby".

line 57: After "unused" insert---lift---.

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*